US007823495B2

(12) United States Patent
Martini Filho

(10) Patent No.: US 7,823,495 B2
(45) Date of Patent: Nov. 2, 2010

(54) PROCESS FOR MANUFACTURING TRACKABLE AMMUNITION

(75) Inventor: Laudermiro Martini Filho, Ribeirao Pires (BR)

(73) Assignee: CBC - Companhia Brasileira De Cartuchos, Sao Paulo (BR)

( * ) Notice: Subject to any disclaimer, the term of this patent is extended or adjusted under 35 U.S.C. 154(b) by 0 days.

(21) Appl. No.: 11/576,921

(22) PCT Filed: Oct. 14, 2004

(86) PCT No.: PCT/BR2004/000198

§ 371 (c)(1),
(2), (4) Date: Nov. 20, 2007

(87) PCT Pub. No.: WO2006/039766

PCT Pub. Date: Apr. 20, 2006

(65) Prior Publication Data

US 2008/0184873 A1 Aug. 7, 2008

(51) Int. Cl.
*C06B 21/00* (2006.01)

(52) U.S. Cl. ..... 86/1.1; 42/1.01; 86/55; 430/935

(58) Field of Classification Search ..... 430/935
See application file for complete search history.

(56) References Cited

U.S. PATENT DOCUMENTS

| | | | | |
|---|---|---|---|---|
| 5,698,816 | A * | 12/1997 | Roxby | 102/516 |
| 6,293,204 | B1 * | 9/2001 | Regen | 102/430 |
| 2002/0178959 | A1 * | 12/2002 | Rennard | 102/430 |
| 2003/0217665 | A1 * | 11/2003 | Rennard | 102/430 |
| 2005/0045056 | A1 * | 3/2005 | EkenediliChukwu | 102/430 |
| 2005/0241203 | A1 * | 11/2005 | Lizotte et al. | 42/1.01 |
| 2006/0162216 | A1 * | 7/2006 | Kinoshita | 42/1.01 |
| 2006/0174531 | A1 * | 8/2006 | Lizotte et al. | 42/1.01 |

* cited by examiner

*Primary Examiner*—Troy Chambers
*Assistant Examiner*—Samir Abdosh
(74) *Attorney, Agent, or Firm*—Bennett Jones LLP

(57) ABSTRACT

The present invention refers to a process for manufacturing ammunition labeled with a sequence of characters which allows identification multiple data items, being said sequence of characters (1) laser-engraved, in one or more components of said ammunition, affording positive identification upon retrieval of an engraved component of said ammunition, even if it is already spent.

9 Claims, 4 Drawing Sheets

PROCESS FOR MANUFACTURING TRACKABLE AMMUNITION

The present invention refers to a process for manufacturing ammunition labeled with a sequence of characters which allows identification multiple data items, being said sequence of characters laser-engraved in one or more components of said ammunition, affording positive identification upon retrieval of an engraved component of said ammunition, even if it is already fired.

BACKGROUND OF THE INVENTION

Public safety is a point of ever-increasing importance in the society we live in. In this context, control of use of firearms and their ammunitions is an indispensable aid, which though highly desirable, is difficult to implement. Positive establishment of ammunition origin, once made feasible, would certainly aid on the work of investigators, remarkably improving the performance of the agencies responsible for keeping public safety. That would require the availability of a process for indelible marking of the ammunition manufactured with elements that allow its identification.

The purpose of the present invention is the positive identification of ammunition from retrieval and inspection of one of its engraved components, even after the ammunition is spent.

In the present document, ammunition is defined as the complete set of cartridge case, projectile, propellant and primer, with all these elements assembled such as to form a single body, being the terms ammunition and cartridge deemed synonymous.

Cartridge case is herein defined as the cylindrical, conical or bottle-shaped capsule of the cartridge, in which are assembled the primer use and the projectile, containing also he propellant (typically smokeless powder). The cartridge case features an element named extractor groove collar or cannelure, typically placed in the area near the case base, which purpose is to aid in the process of empty case extraction after the cartridge is fired.

STATE OF THE ART

The current state of the art regarding ammunition identification de is restricted to the engraving of a small amount of data in some ammunition component.

Normally said engraving is performed mechanically by press-stamping the data in the outer face of the cartridge case base. In some cartridges the marking is placed on the lateral outer face of the cartridge case.

Alternatively, the data may be engraved using techniques such as silk-screen or similar printing techniques.

The current state of the art features some drawbacks. Regarding the press-stamping method, one of the drawbacks is the requirement of previous manufacture of non-reusable press-stamping dies, specific for each of the production batches to be engraved, which adds to the global manufacturing cost. Said cost increases with the manufacture of extra press-stamping dies, so as to make possible the replacement of any die accidentally damaged during the engraving process. For short-run batches (i.e. reduced series), the cost of press-stamping dies might add a lot to the global manufacturing cost. One must also consider the progressive wear of the press-stamping die even under normal use, which may eventually compromise the quality/readability of the engraved data.

The need to change the press-stamping die (or conversely the printing screen for silk-screen labeling) upon changing the recorded data between batches manufactured in succession entails an idle time which increases the manufacturing and operational costs, demanding intervention of specific manpower.

Another inconvenience of the engravings made by press stamping or silk-screen is the fragility of the engraving as far as cartridge handling/normal use is concerned. Both the press-stampings (specially the very shallow ones) and silk-screen and similar printing techniques tend to loose readability when submitted to impacts and scraping, and the silk-screen also tend to fade with the passage of time, thus compromising the durability of the markings. In other words, these techniques yield a labeling that is not indelible, denying reliability to the proposed identification system.

The consideration of the ever-present risk of intentional counterfeiture of the identification markings expose further inconveniences of the state of the art techniques. The very positioning of the markings (normally limited to the outer face of the case base or the lateral outer face of the case) allows easy access of the tools typically used in the adulteration of the engraved markings.

In the case of manufacturing successive batches of cartridges made up of different materials (plastic and brass, for instance), the engraving devices of the state of the art require the interruption of the productive process to allow the adjustment of the engraving equipment to the new material, which normally feature different superficial hardness, density, etc. which render said adjustments mandatory.

Another drawback identified in some examples of the state of the art is the limited quantity of information that can be displayed by the engraving, which is usually limited to manufacturer, caliber and type of ammunition.

Finally, the placement of the engraving step of the state of the art on the first part of the production line tends to facilitate failure in the system (mistaken identification, erroneous total counting in a given batch, etc.), because said engraving is performed in one of the elements that will be part of the ammunition before its assembly in the final product, being said element submitted to other processes before it is actually assembled in the ammunition.

BRIEF DESCRIPTION OF THE DRAWINGS

The present invention can be better understood from the reading of the following description along with the attached figures, wherein.

DESCRIPTION OF THE INVENTION

Figure 1:
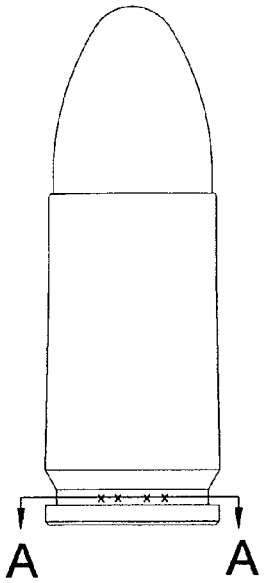
FIG. 1 illustrates a side elevation view of a cartridge according to the present invention.
Figure 2:
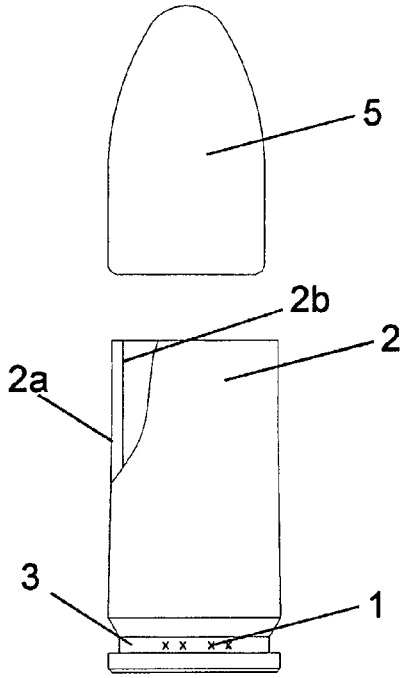
FIG. 2 illustrates the same cartridge of FIG. 1, now with the projectile separated from the cartridge case.
Figure 3:
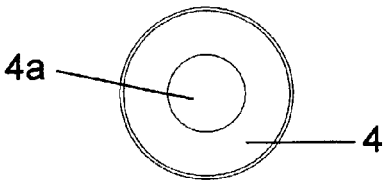
FIG. 3 illustrates a rear plan view of the ammunition, presenting the external face of the case base.
Figure 4:
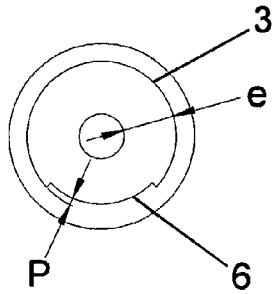
FIG. 4 illustrates a sectional view taken along line AA on FIG. 1, presenting a reduction of the original thickness of the cartridge case (2) wall in the region of engraving of the identification characters.
Figure 5:
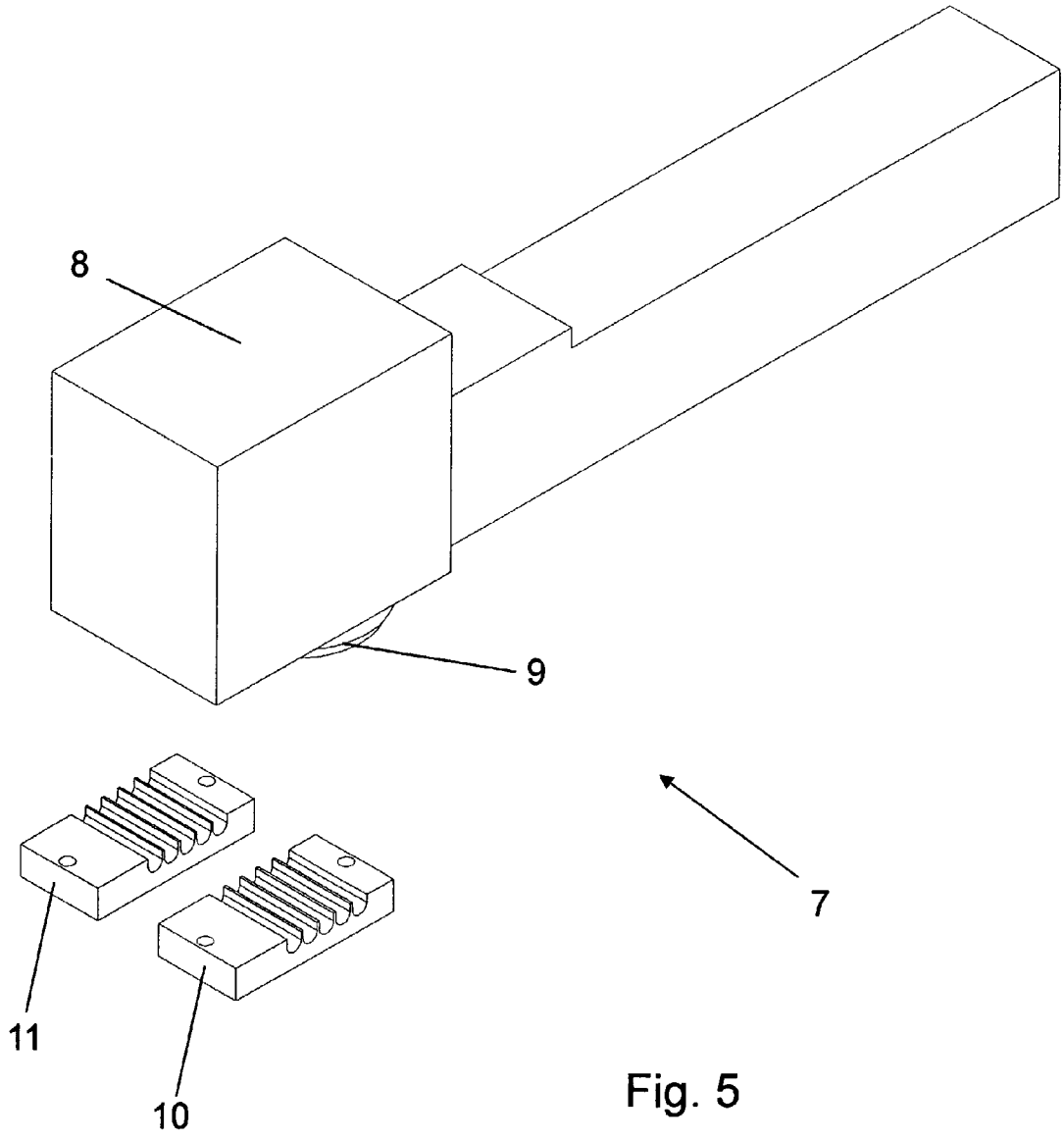
FIG. 5 illustrates a perspective view of the engraving station including the laser beam generator, the positioning cradle and the conveyor cylinder according to the present invention.
Figure 6:
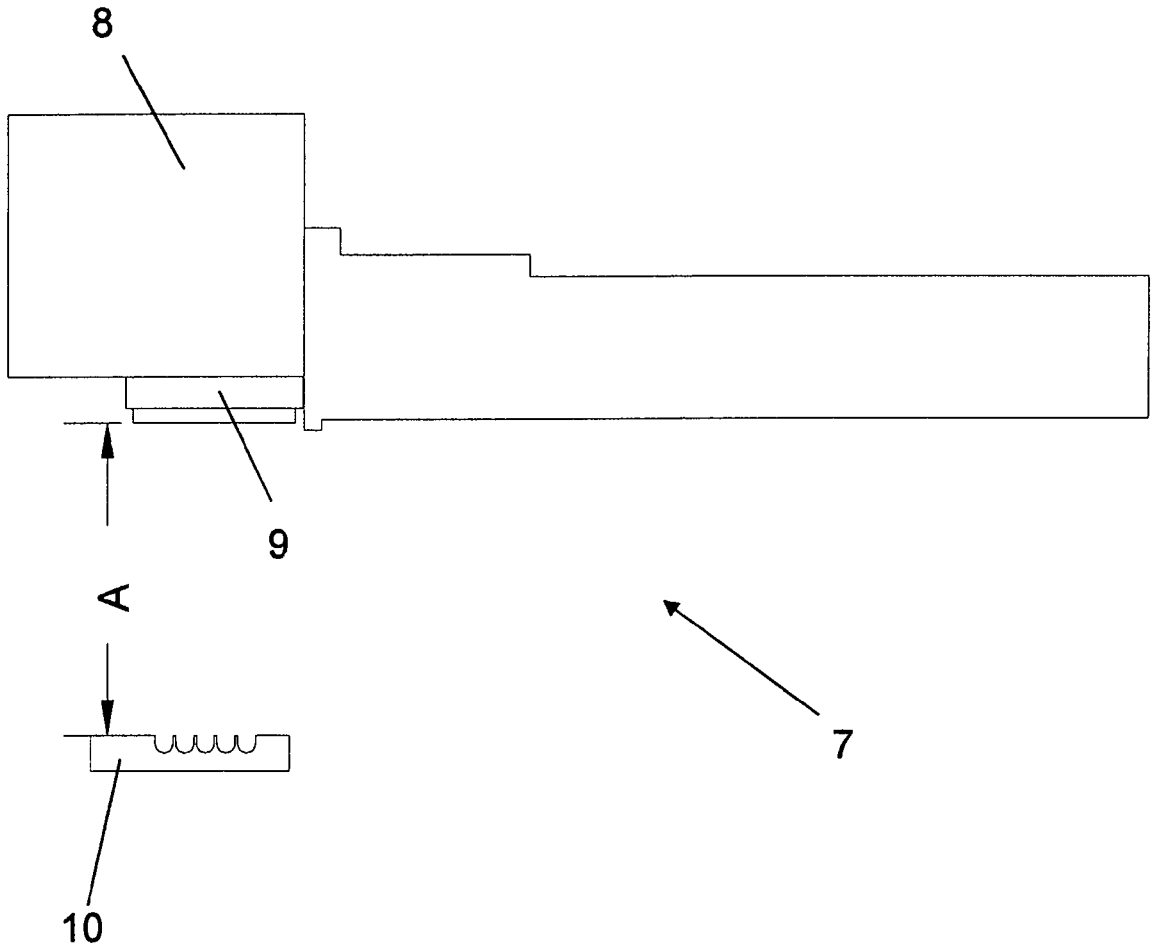
FIG. 6 illustrates a side elevation view of the engraving station indicating the spacing a between the lower surface of the laser generator lens and the surface to be engraved according to the present invention.
Figure 7:
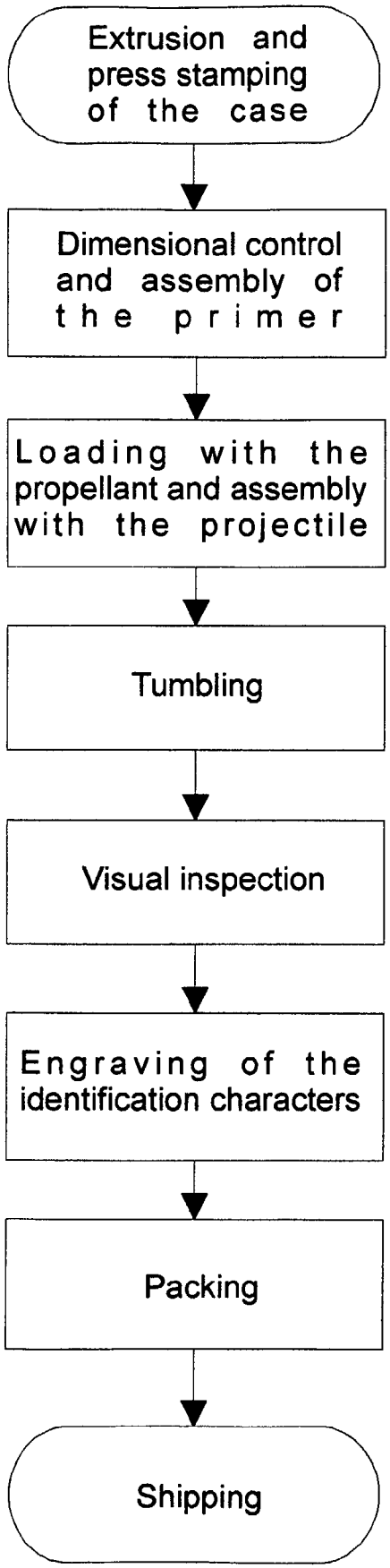
FIG. 7 illustrates a schematic flow-chart of the process disclosed in the present invention.

Among the elements that make up the present invention, there are a set of identification characters (1), the cartridge case (2), an extraction groove (3), the outer face of the case base (4), the primer (4*a*), the projectile (5), the region of the bottom of the groove (3) that is the surface to be engraved (6), the engraving station (7) containing the laser beam generator (8), the lens (9) that aims the laser, the positioning cradle (10) and the conveyor cylinder (11).

The process of the present invention has the following execution order:

Extrusion and press-stamping of the cartridge case (2), dimensional control, assembly of the primer (4*a*), loading of the propellant and assembly with the projectile (5), tumbling (cleaning of the case (2)) to ensure precision of the laser engraving), visual inspection, engraving of the identification characters (1) and packaging in carton boxes and labeled outer packings, followed by shipping.

In the process according to the present invention, the engraving of the identification characters (1) is performed by means of a laser beam generator (8) that sweeps the surface to be engraved (6) and prints said characters through a process of selective elimination of matter. The cartridges (1) are conveyed to the engraving station (7) with the aid of a conveyor cylinder (11). Upon reaching the entrance of the engraving station (7), the cartridges are distributed on a positioning cradle (10) (known in the industry by the name of "collector"). A fundamental requirement to ensure good performance of the system is to ensure that the distance "A" is kept between the lower face of the laser beam aiming lens (9) and the surface to be engraved (6). With that in mind, each kind and caliber of ammunition uses a specific positioning cradle (10), which gauge ensures the proper spacing between the case (2) and the laser beam aiming lens (9).

The basic parameters to control the laser emission are the wavelength "λ", emission frequency "f", plan displacement speed "v" of the laser beam and the focal distance "β". The emission frequency "f" is related to the energy actually transmitted by the laser beam, so that lower frequencies generate deeper penetration and higher frequencies yield a smoother finishing of the surface. The plan displacement speed "v" of the laser beam is directly related to the manufacturing rate, being however limited by the finishing standard requirements.

It is important to consider the physical phenomenon involved in the laser engraving as implemented in the present invention. Considering the risk of accidental ignition of the case (2) contents (propellants, primer, etc.), it is fundamental to avoid any major temperature increase of the case (2) upon engraving the identification characters (1). Conversely, from a strictly commercial point of view, it is desirable to make the time spent in the engraving step the shortest possible, favoring a high production rate and cutting costs. Therefore it is desirable to establish a compromise between safety and production speed. Said compromise is secured, in the present invention, through a precise control of the focal distance "β" of the laser beam used for engraving. A concentrated and steady focus of the laser beam allows a quick pulverization of the material in the region to be engraved due to the concentration of the energy transmitted. However this very same concentration ensures there will be a sufficient amount of matter around the focal point to ensure quick dissipation of this energy with no major increase of the case (2) temperature, thus lowering the risk of accidental firing of the ammunition during the engraving step. That explains the importance of using a specific positioning cradle (10) for each type and caliber of ammunition, which ensures the engraving is performed with the ideal focal distance "β", said distance corresponding to the distance between the ammunition and the laser beam aiming lens (9).

For illustrative purposes, in a preferred example of the present invention, the cycle time of the engraving step is 2.5 seconds, while the positioning cradle (10) remains actually still inside the engraving station (7) for 1.7 seconds, enough for the safe and precise of a set of five identification characters (1).

Besides the safety considerations contemplated during the engraving step itself, the laser engraving as implemented in the present invention observes the importance of the depth limits of said engraving. The lower limit is that in which the identification characters (1) are no longer indelible, being in fact shallow enough to threaten readability on account of accidental impacts and scraping and/or compromising the durability of the labeling. The bottom limit is that in which the thickness of the (2) wall is so reduced in the points of engraving that two local, undesirable phenomena ensue:

1) fragilization of the metallic arrangement of the subjacent metal sheet lying beneath (that is, fragilization of the material even tough a certain minimal thickness is preserved), and 2) the amount of energy transferred to the other side of the engraved sheet (in contact with the primer, propellant, etc.) becomes relevant, increasing the risk of accidental firing of the ammunition.

The tests performed by the Applicant established that, assuming the engraving depth to be equal to "p" and the original thickness of the case (2) wall to "e", the preferential critical limits would be in the order of:

$p_{min}$=20 μm $P_{max}$=0.1.e

The present invention implements a codification system that uses only and exactly five characters (alphanumeric or not) for the identification of the features of interest on a given ammunition. The list of said features is flexible and rather long, including the name and file data of the ammunition buyer, batch number, date of purchase, technical characteristics of the ammunition and many other information. The correspondence between this ammunition data string and the specific sequence of five identification characters (1) engraved in one or more of its component elements is biunivocal. In other words, each sequence of five identification characters (1) corresponds to a data string that is unique for the ammunition thus identifier, and to each data string corresponds one unique sequence of five identification characters (1). The databank that associates the data strings and the sequences of five identification characters (1) is stored by the manufacturer, and consultation is allowed to duly authorized security agencies according to public interest.

The use of five identification characters (1) that characterize the present invention is not random, being in fact critical for its feasibility. The point is the surface of the case (2) which will be recorded is in fact not plan, but circular (being the radius a function of the specific ammunition caliber at hand). Considering that the laser beam aiming lens (9) moves along a horizontal line that is tangent to said circumference, it is plain to see that the distance between the laser beam aiming lens (9) and the surface to be engraved in the ammunition varies as the laser beam sweeps the region of engraving. It has already been pointed out that the keeping of this distance is critical for the laser beam focus, and thus for its performance. Furthermore, the first and the last characters in the sequence of five identification characters (1) tend to offer the laser beam aiming lens (9) a surface already well inclined (that is, a non-perpendicular incidence, favoring the distortion of the characters to be engraved. Therefore, in order to ensure readability of all the identification characters (1), it would be best if the total number of engraved characters is small, compounded by the fact that a large number of characters would require a longer interval with the positioning cradle (10) sitting still inside the engraving station (7), reducing the production rate. However, the largest the number of identification characters (1), the larger the number of different characters combinations possible, enhancing the number of codifications available for use. Aware of the aspects already discussed, the Applicant judges that the use of exactly five characters (alphanumeric or not) offers a good equilibrium compromise between the limitations and advantages at hand.

Alternatively, it would be possible to implement an additional degree of freedom in the displacement of the laser beam aiming lens (9), so as to allow the lens to move not along a horizontal line, but instead along a circular arc that follows the perimeter of the cartridge case (2). This would allow the engraving of more than five identification characters (1) without compromising readability due to optical aberrations (because the laser beam would hit the cartridge case (2) surface perpendicularly) or laser focus imprecision (because the spacing would be kept constant). In exchange for that, a new, specific system calibration would be required for each ammunition, according to its caliber.

The engraving of the identification characters (1) according to the present invention can be accomplished in several parts of the cartridge case (2), being preferential the engraving inside the reduced-diameter ring which lies near the outer face of the cartridge case base (4), known in the industry as extractor groove (3). The function of the extractor groove (3) is to orient the system for ejection of the fired cases (2).

Some types and calibers of ammunition do not feature the extractor groove (3) in their original form. In this cases it is possible to introduce the forming of an extractor groove (3) upon milling the cartridge case (2) or else choose to engrave the identification characters (1) on another part of the ammunition (on the side of the cartridge case (2), for example).

The Applicant has also considered the alternative of engraving the identification characters (1) in the projectile (5), choosing however to ignore this alternative in view of the drawbacks associated to it, such as for example warping/fragmentation of the projectile (5) once the ammunition is fired, rendering the characters unreadable.

The present invention also considers the alternative disposition of a verification step by means of laser reading immediately upstream of the engraving station (7), serving as an additional resource to check proper and integral performance of the manufacturing instructions originally presented to the system.

The present invention also considers the alternative disposition of multiple engraving of the same codes in other positions on the same cartridge case (2) (on the extraction groove (3), on the lateral outer face of case (2*a*), etc.) ensuring positive identification even when one of the characters has suffered some sort of damage that impairs its readability.

The present invention also considers the alternative disposition of engraving the identification characters (1) on the inner lateral face of the cartridge case (2*b*), by means of adequate placement of mirrors or other reflective means inside the cartridge case (2) that would deflect the laser beam during the engraving step.

The present invention contemplates, with no major modifications, the option of engraving an empty cartridge case (2), to be sold in this condition for subsequent assembly of the ammunition by the purchaser.

Alternatively, the engraving of the manufacturer's name, caliber and type of cartridge case (2) in a non-coded manner which is typical of the current state of the art, normally performed by press-stamping of the outer face of the cartridge case base (4), could be replaced by a laser engraving process similar to that used in the engraving of the identification characters (1) of the present invention. This change in the manufacturing scheme would pose significant advantages from the standpoint of physical space occupation, flexibilization of the manufacture process and resource economy.

The present invention presents many advantages when compared to the current state of the art. Among these, it is worth mentioning a remarkable simplification in the tracking and identification of ammunition already shipped in case of an eventual, post-purchase technical revision (i.e. technical recall).

Another advantage of the present invention is that there is no mechanical contact between the engraving device and the ammunition, thus eliminating the wear of the components and ensuring a consistent quality standard along the whole engraving process, regardless of the number of unit engraved.

Another advantage of the present invention is that the laser engraving device operates regularly regardless of the material that makes up he engraved element of the ammunition, allowing quick handling of material changes through simple adjustment of the frequency "f" of the laser beam, something that is easy to implement through computer resources, which would not compromise production rate in the event of sequenced manufacture of ammunition batches made up of different materials (plastic and brass, for instance).

An interesting, practical aspect of the engraving depth limits adopted by the Applicant in the present invention is related to the eventual process of adulteration and unauthorized reuse of fired cartridge cases (2). In order to adulterate the originally engraved characters, it would be necessary to mill/polish the engraved surface to make smooth once again, and only then engrave the new set of characters. However this further polishing would render the new engraving unfeasible, because it would reduce the structural strength of the cartridge case (2) because of the reduction of the minimum preserved wall thickness. That characterizes an important safety advantage derived from the implementation of the engraving process according to the present invention.

The choice of the bottom of the extractor groove (3) as the preferential region for engraving the identification characters, as recommended in the present invention, offers as an additional advantage the fact that the metallic surface of the bottom of the extractor groove is easier to engrave than, for instance, the lateral face of the case (2) which presents a smaller thickness and can also be polished/milled. Furthermore, the small dimensions and the very geometry of the extractor groove hinder the access of the tools normally used to adulterate engraved markings, thus contributing to preserve the trackability of the ammunition.

The fact that the engraving of the identification characters (1) is performed immediately before the packaging of the ammunition in carton boxes (and subsequently outer packings duly labeled with bar codes) remarkably reduces the probability of control system error (counting errors, undue inclusion of cartridges (1) in a batch, etc.). Associated to the alternative disposition of a verification step using laser reading immediately upstream the engraving station (7), this "late engraving" practically eliminates the possibility of discrepancies between the ammunition which was intended to be placed inside the package and that actually gets packed. This resource configures an enormous advantage, in view of the safety aspects related to the precise tracking of every ammunition unit that is sold.

INDUSTRIAL APPLICABILITY

The process contemplated in the present invention is clearly applicable to an industrial scale, being assured the reproduction of the results observed during its development.

Those skilled in the art will observe the fact that the uses of the present invention are not limited by the practical examples proposed for illustrative purposes, being possible to introduce modifications in form and detailing without departing from the spirit and scope of the invention as defined by the following set of claims.

What is claimed is:

1. A process for engraving a fully assembled round of trackable ammunition made up of a case featuring an extractor groove, a cartridge case base, a primer and a projectile, wherein the engraving of identification characters of said ammunition is performed by selective pulverization of matter ensued by means of a laser light beam which maximum penetration depth "p" in the order of 0.1e, being "p" defined as the value of the penetration depth and "e" the original thickness of the case wall.

2. A process for manufacturing trackable ammunition according to claim 1, wherein the set of identification characters of said ammunition is engraved at the bottom of the extractor groove.

3. A process for manufacturing trackable ammunition according to claim 1, wherein the engraving of each type and caliber of ammunition uses a specific positioning cradle for keeping a previously set distance "A" between the ammunition and the lower surface of a laser beam aiming lens.

4. A process for manufacturing trackable ammunition according to claim 2, wherein the engraving of each type and caliber of ammunition uses a specific positioning cradle for keeping a previously set distance "A" between the ammunition and the lower surface of a laser beam aiming lens.

5. A process for manufacturing trackable ammunition according to claim 1, wherein the code engraved in the ammunition uses five identification characters, alphanumeric or not, for identification of the specific characteristics of interest for each unit of ammunition that is manufactured.

6. A process for manufacturing trackable ammunition according to claim 2, wherein the code engraved in the ammunition uses five identification characters, alphanumeric or not, for identification of the specific characteristics of interest for each unit of ammunition that is manufactured.

7. A process for manufacturing trackable ammunition according to claim 3, wherein the code engraved in the ammunition uses five identification characters, alphanumeric or not, for identification of the specific characteristics of interest for each unit of ammunition that is manufactured.

8. A process for manufacturing trackable ammunition according to claim 1, wherein the engraving of the identification characters is performed immediately before packaging of the ammunition.

9. A process for manufacturing trackable ammunition according to claim 1, wherein the engraving of the identification characters is performed immediately before the packaging of the ammunition, further comprising a laser reading device positioned upstream of the packing device for reading the identification characters and checking the consistency between the manufacture instructions and the ammunition actually packed.

* * * * *